United States Patent [19]

Teglund et al.

[11] Patent Number: 4,480,655

[45] Date of Patent: Nov. 6, 1984

[54] LIQUID-PLUG-CREATING DEVICE

[75] Inventors: Lars Teglund, Gustavsberg; Pentti Kosonen, Saltsjö-Boo; Melchiorre Oldani, Gustavsberg, all of Sweden

[73] Assignee: Aktienbolaget Gustavsberg, Gustavsberg, Sweden

[21] Appl. No.: 310,875

[22] Filed: Oct. 13, 1981

Related U.S. Application Data

[63] Continuation-in-part of Ser. No. 093,988, Nov. 14, 1979.

[30] Foreign Application Priority Data

Nov. 22, 1978 [SE] Sweden ..... 7812055

[51] Int. Cl.[3] ..... F04B 10/00

[52] U.S. Cl. ..... 137/132; 137/138; 137/247.41

[58] Field of Search ..... 137/132, 134, 139, 138

[56] References Cited

U.S. PATENT DOCUMENTS

| | | | |
|---|---|---|---|
| 181,569 | 8/1876 | Field | 137/132 X |
| 252,344 | 1/1882 | Williams | 137/139 X |
| 475,396 | 5/1892 | Hawley | 137/138 X |
| 1,235,641 | 8/1917 | Berry | 137/139 |
| 2,469,825 | 5/1949 | Hornstein | 137/132 X |
| 2,589,068 | 3/1952 | Fuaus | 137/132 X |
| 3,233,448 | 2/1966 | Brown | 137/132 X |

FOREIGN PATENT DOCUMENTS

| | | | |
|---|---|---|---|
| 2624 | of 1879 | United Kingdom | 137/134 |
| 1221 | of 1889 | United Kingdom | 137/138 |
| 335331 | 9/1930 | United Kingdom | 137/247.45 |

*Primary Examiner*—Harold W. Weakley

*Attorney, Agent, or Firm*—Toren, McGeady and Stanger

[57] ABSTRACT

A liquid-plug-creating device includes a collection tank or basin into which liquid flows such as the outflow from sanitary appliances. From the outlet at the bottom of the tank a riser extends upwardly at an acute angle to the horizontal. At the opposite end from the tank outlet, the riser terminates in a bend which reverses the direction of flow through the riser into a downwardly extending vertical pipe. A U-shaped piece of pipe with a horizontal outlet is connected to the lower end of the vertical pipe and provides a special form of trap. When the tank and the riser are completely filled with liquid, any additional liquid added exceeding a minimum flow, causes a liquid seal to be formed in the piece of pipe at the lower end of the vertical pipe. The excess flow creates a vacuum in the vertical pipe which sucks the liquid through the riser out of the tank in the manner of a siphon. The liquid immerges from the device in the form of continuous plugs with high kinetic energy content. The device permits the use of small-diameter pipes in house drainage systems while assuring the required self-cleansing effect, even if water-conserving flush toilets are connected to the device. Other fields of application of the device are irrigation and the metering of liquids in batches.

1 Claim, 5 Drawing Figures

LIQUID-PLUG-CREATING DEVICE

CROSS-REFERENCE TO RELATED APPLICATIONS

This is a continuation-in-part application of prior application Ser. No. 093,988 filed on Nov. 14, 1979.

SUMMARY OF THE INVENTION

In the present invention a liquid-plug-creating device includes a collection tank or basin for water, such as sanitary sewage or the like. Initially a pipe runs upwardly at an acute angle from the outlet of the tank to an overflow level followed by a straight vertical drop to a partially U-shaped piece of pipe constituting, in its resting state, an incompletely sealing water trap connected to a generally horizontally extending sewer or drainage line or the like. Both small, continuous quantities of liquid and large intermittent quantities can flow through the device, the latter emerging as liquid plugs with a large kinetic energy content. Such liquid plugs are highly desirable to prevent blockages, such as in sanitary drainage lines from residential buildings and the like, where, with free flow, the line would otherwise not be self-cleansing. Another area where the liquid transport in plug form is desirable is in sub-surface irrigation pipes of the infiltration type connected to lift pumps.

The amount of liquid discharged into the sanitary drainage system from a residential building is more than 200 liters per person per day. Of this amount, 40 liters is flush water from water closets, by which most of the settleable waste is discharged into the drainage pipe. A large portion of the water enters the drainage pipe at a low flow rate, while the soil water from a water closet comes in surges, when it is flushed.

Nowadays, there are many different types of water closet which can be flushed satisfactorily under normal pressure with 3 liters of water, for instance the water closets used in the Gustavsberg Water Saving System. Still smaller quantities of flush water are used in vacuum systems. Such water-conserving flush toilets are not approved for connection to municipal sewer systems because the soil may tend to settle out in the sewer, so that the sewer is no longer self-cleansing.

The self-cleansing capacity of a drainage or sewer line is dependent to some extent upon its diameter. However, the results of experiments with the sizing of drainage systems in buildings where water closets with reduced flush water quantities are used, have not yet been published. Nor is there any documentation concerning the sizing of underground street sewers to which such water-conserving toilets are connected.

In general, sewer and drainage line should be sized to handle the maximum possible volume of water likely to occur and to make them self-cleansing. Formerly, the self-cleansing requirement has often been linked to the required water velocity. A water velocity of 0.6 m/s has been specified as the minimum required for self-cleansing in waste water lines. The time span for which this velocity applies varies between different countries. But in all countries, the water velocity is specified regardless of pipe size, and refers to the peak velocity on the minimum day; to be more exact, the velocity of the water flow during the peak hour on the minimum day. The minimum day is thereby defined as that day of the year when a sewer or drainage line is subjected to the minimum flow load. The peak hour is that hour when the flow from other drainage fixtures than the water closet is greatest. Somewhat simplified, the design flow is the flow which occurs when the maximum number of water closets connected to the drainage or sewer line in question are flushed during the peak hour. This method of design calculation is the basis for the approval by the Swedish authorities of water closets which flush with 6 liters of water.

Recently, self-cleansing has been linked to the shear stress along the bottom of the pipe which occurs during water flow. This method of calculating self-cleansing capacity is employed in the Swedish building code. The requirement on adequate protection against sludge deposits is met if the shearing force according to the following formula is 0.25 kgf/m$^2$ (2.45 Pa).

$S = J \times R \times \gamma$ $S$ = Shearing force (kgf/m$^2$)

$J$ = Declination of pipe (m/m)

$R$ = Hydraulic radius (m$^2$/m)

$\gamma$ = Density (ton/m$^3$)

$$\text{Hydraulic radius} = \frac{\text{cross sectional area of water}}{\text{wet circumference of pipe}}$$

Researchers are still in dispute as to which of the two applied methods for calculating self-cleansing capacity conforms most closely to the real situation. Large-scale research projects are currently under way at different research institutions around the world, and they are being conducted with high priority due to the increased acute water shortage.

More or less the same line of reasoning applies to the self-cleansing capacity of sewer lines, including service lines, as to drainage lines within a building. There is an important difference, however, the sewer pipes are of much larger diameter, which means that the required flow volume is much greater. A special and important case is waste water lines within residential areas with only a few connected service lines, i.e., with intermittent and, on the average, very low water discharge flows. It is uncertain whether the above type of approach is at all applicable here as regards self-cleansing. The organic waste consists to a great extent of large clumps (faeces etc.) which have not yet had time to dissolve or to be mechanically dispersed. As this type of waste is transported, the clumps flow with the water, sometimes touching the bottom and side walls of the pipe. When the water flow ceases, the clumps settle to the bottom or deposit on the surface of the pipe. The next time water flows through the pipe, they are picked up and carried along for some distance, or, if the water volume is too small, they remain in the same place, perhaps building up due to the settling of further organic clumps. Such a build-up can eventually result in a total blockage.

One way to overcome such problems is to make sure, when sizing waste water lines with respect to self-cleansing, that the flow at some time during the day is great enough to flush any deposited matter away. It has, therefore, been proposed, as explained above, that the flow during the peak hour of the minimum day shall be regarded as the design flow in this connection.

The conclusion that can be drawn from the method described here for determining the design flow for waste water pipes is that if, by means of a special device, it is possible to subject the line intermittently to a large, surge-type water flow, any deposits will be flushed away.

When land is irrigated through underground perforated infiltration pipes, certain problems arise. Since the soils are usually resorptive, the water flowing through the pipe usually seeps out a relatively short distance in a short time. For this reason, such a sub-surface irrigation pipe must have relatively closely spaced inputs, which means that a feed pipe with numerous branches to the infiltration pipe must be laid parallel to the infiltration pipe. If, on the other hand, the water can be sent through the infiltration pipe in the form of a plug, the number of inputs to the pipe can be considerably reduced, eliminating water surpluses in certain sections of the irrigated area. (Such surplus amounts of water evaporate to a great extent, and are, therefore, of no benefit to the crop.)

The purpose of the invention is to create a device from which liquid can be discharged in the form of plugs with a large content of kinetic energy. Two areas of application have been outlined above, namely: (a) for the improvement of the self-cleansing capacity of drainage and sewer pipes, so that such pipes can be made smaller than would otherwise be possible, thanks to the kinetic energy of the water plugs; and (b) to achieve longer transport runs through perforated sub-surface irrigation pipes, due to the fact that the coherent water plug, with its high kinetic energy, travels a relatively long distance, over which the plug gradually shrinks in volume as it loses a portion of its liquid through the perforations in the pipe along the way.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAIL DESCRIPTION OF THE INVENTION

Figure 1:
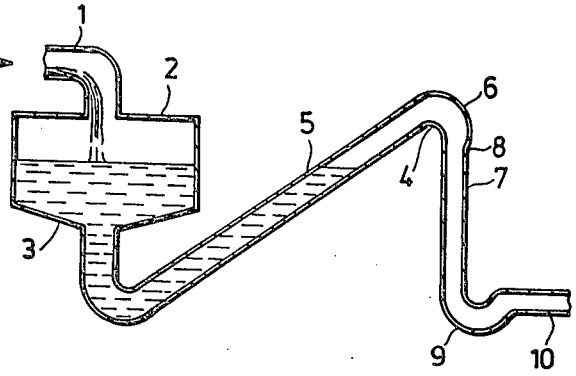
FIG. 1 illustrates the liquid-plug-creating device embodying the present invention in the half filled state.
Figure 2:
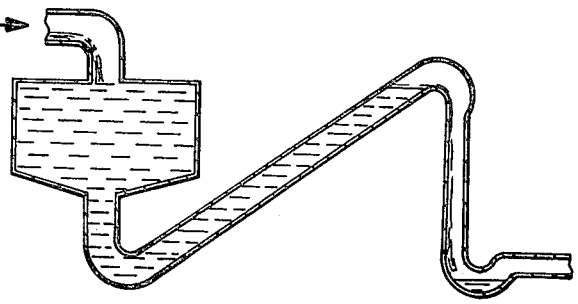
FIG. 2 illustrates the device in the filled state and beginning to adopt its plug-creating function.

Liquid flows into a tank or basin 2 in an inlet line 1, into which the drain pipes from all of the sanitary fixtures in a building empty, or which comes from a lift pump operated by hand, by foot or by oxen or other draught animals. From the bottom 3 of the basin 2, an outlet extends downwardly to a riser 5 which runs upwardly to an overflow level 4 with a chosen gradient. The bottom or outlet 3 from the tank 2 is positioned to assure that all of the material flows out of the tank into the riser 5. Riser 5 extends from the outlet of the tank upwardly at an acute angle to the horizontal. Generally, the angle is less than 45°. At its upper end, spaced from the tank 2, the riser 5 terminates in a pipe bend 6, from which a vertical pipe 7 depends. The overflow level 4 is formed by the invert or bottom of the riser 5 where it is connected to the pipe bend 6. At the transition from the pipe bend 6 to the vertical pipe 7, a diameter change may be effected. This change usually takes the form of a reducer 8, whereby the velocity of the liquid can be altered. It has been demonstrated experimentally that the velocity of the liquid in the vertical pipe 7 increases as its diameter decreases for a given diameter of the riser 5.

At its lower end the vertical pipe 7 is connected by a partially U-shaped piece of pipe 9 to a horizontal outlet 10. The partial U-shape of the piece of pipe 9 stems from the fact that the leg of the piece of pipe connected to the bottom of vertical pipe 7 is a full leg extending upwardly from the bight portion of the piece of pipe, however, the other leg connected to the outlet pipe 10 is not a full leg, it does not extend upwardly from the bight portion to the same extent. The invert of the outlet 10 at its connection to the pipe 9 is located above the lowermost point of the invert of pipe 9 and below the crown of pipe 9 opposite the lowermost point. As a result flow may pass through the U-shaped piece of pipe 9 without forming a seal at the lowermost part of the pipe. Depending on the volume of flow through the U-shaped piece of pipe 9 a sealing effect may be provided or a non-sealing water trap may result. The outlet 10 can be connected to a municipal sewer line, or, if an irrigation system is involved, to the outgoing infiltration pipe.

Figure 3:
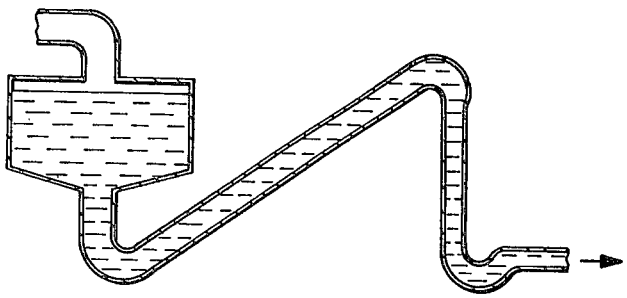
FIG. 3 shows the device completely full with a coherent water plug on its way out into the discharge line.
Figure 4:
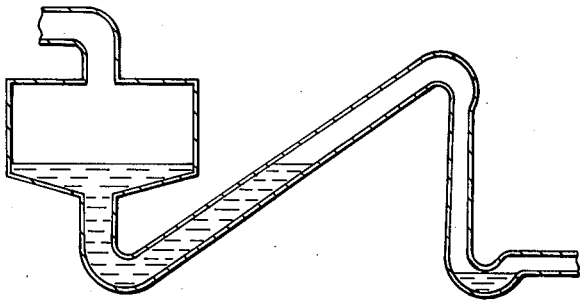
FIG. 4 shows the liquid remaining in the device after the departure of the water plug.

The device works in the following manner:

Liquid flows through the inlet pipe 1 into the tank 2. Owing to the fact that the tank 2 and the riser 5 communicate, the liquid finds the same level in both. The invert or overflow level 4 in the riser 5 is at the same level as the top of the tank 2. When the liquid in the tank 2 has reached this level, an amount of liquid normally equal to the flow into the basin 2 runs over the overflow level 4 in the riser 5. If this flow into the tank is small, only a small quantity of liquid per unit time flows downwardly through the vertical pipe 7 and into the U-shaped piece of pipe 9, which functions under such low flow-conditions as an incompletely sealing water trap. Since the system operates under atmospheric pressure, the flow emerging from the piece of pipe 9 is equal to the flow into the inlet pipe 1. If this incoming flow increases, the volume of liquid passing into the vertical pipe 7 also increases so much that the water trap in the piece of pipe 9 closes, in other words the cross section of the pipe 9 at its lowermost point between the invert and crown is filled with the liquid. If the increased flow continues for a second or so, a coherent water plug will have had time to form in the piece of pipe 9 and then leaves through the outlet pipe 10. A vacuum is thereby created in the vertical pipe 7, whereby liquid is sucked out of the riser 5 and the basin 2. This suction increases the flow through vertical pipe 7 so much that a new liquid plug forms immediately in the piece of pipe 9. Actually, these steps take place so rapidly that it is no longer possible to speak of separate liquid plugs, but rather a continuous column of water flows from the basin 2 through the riser 5 and the vertical pipe 7 and out through the piece of pipe 9 into outlet pipe 10, as illustrated in FIG. 3. The coherent water column is forced by atmospheric pressure into the inlet pipe 1 through the device, which thereby functions as a siphon until all liquid has been emptied from the basin and air is sucked out into the riser 5. The siphon then ceases to draw, and the device returns to its at rest stage, as illustrated in FIG. 4.

Figure 5:
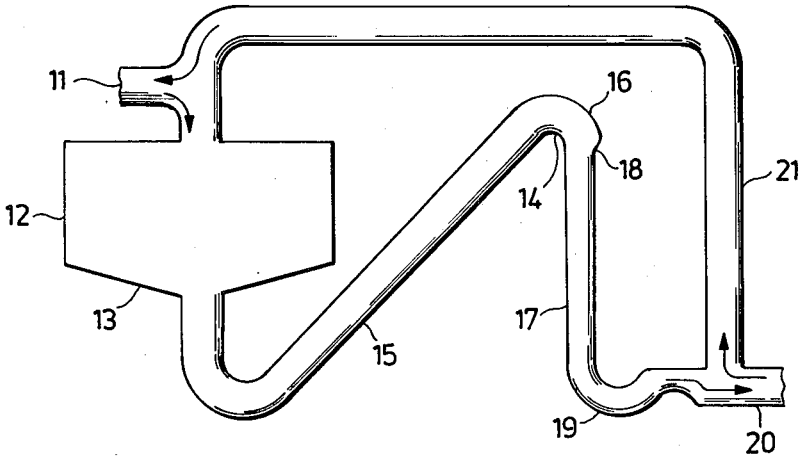
FIG. 5 shows a variation of the invention with a vent connection between the discharge line and the incoming line.

The variant of the invention shown in FIG. 5 cannot be used in vacuum systems, being mainly intended for drainage systems operating under atmospheric pressure. Like the standard version, it has an inlet pipe 11 connected to the top of a basin 12, from the bottom 13 of the basin an outlet depends downwardly and a riser 15 extends upwardly from the outlet at a selected acute angle relative to the horizontal. The riser ends in a pipe bend 16, whose invert constitutes the overflow level 14 of the riser. A vertical pipe 17 depends from the pipe bend 16 via a reducer 18. At its lower end, the vertical pipe 17 connects to a partially U-shaped piece of pipe 19, which connects horizontally on its outlet side to a sewer line 20. The invert of the sewer line 20 is lower than the invert of the piece of pipe 19 where it connects to the sewer line. A vent line 21 branches off from the sewer line 20 and connects to the inlet pipe 11. The effect of this vent line 21 is such that a water plug emerging from the piece of pipe 19 never has to work against a back-pressure in the sewer line 20. If a blockage should occur further on in the sewer line 20, preventing air in the pipe from passing freely through it, this air can be diverted via the vent line 21 to the inlet pipe 11, and from there be vented to the atmosphere through the vent lines which are normally provided in the building.

The device has been described here as a carrier of waste water from a conventional drainage system. By means of an appropriate design and sizing of the riser 5, however, it can easily be adapted to drainage systems operating under vacuum. It can also be modified to serve as a metering device in manufacturing processes where a liquid ingredient is to be metered out in batches, and where volume variations on the order of ±10% are acceptable.

While specific embodiments of the invention have been shown and described in detail to illustrate the application of the inventive principles, it will be understood that the invention may be embodied otherwise without departing from such principles.

We claim:

1. Liquid-plug-creating device for creating both a small, continuous flow of liquid and a large, intermittent flow of liquid in plug-like form with large kinetic energy content in pipes, comprising a collection tank for water, sewage or the like, said tank having a bottom and a closed top spaced upwardly from said bottom, an outlet from said bottom of said tank positioned so that all of the contents of said tank can flow out of said outlet, an inlet into the closed top of said tank, an outlet pipe having a dependent section connected to said tank outlet and extending downwardly therefrom, said outlet pipe including a bent portion connected to the lower end of said dependent section and said bent portion bent in a vertical plane, a riser having an inlet end and an outlet end with the inlet end connected to said bent portion and with said riser extending angularly upwardly from said bent portion of said outlet pipe, a pipe bend bent in a vertical plane is connected to the outlet end of said riser for reversing the upward flow through said riser to a downward flow, a generally vertically extending pipe extending downwardly from said pipe bend, said vertically extending pipe having a reducer at the end thereof connected to the said pipe bend so that a reduction in the flow cross-section takes place from said riser into said vertically extending pipe, the invert of said pipe bend forms an overflow level for flow into said generally vertically extending pipe, and is located not lower than the inlet into the closed top of said tank, a piece of pipe connected to the lower end of said vertical pipe and comprising a partially U-shaped section having an inlet end connected to the lower end of said generally vertically extending pipe and a horizontally extending outlet end, and a generally horizontally extending section connected to said outlet end, said piece of pipe forming a direct passageway from the lower end of said vertically extending pipe into said generally horizontally extending section so that all of the flow downwardly through said vertically extending pipe passes directly into said generally horizontally extending section, the invert at the horizontally extending outlet end of said partially U-shaped section is located above the lowermost point within said piece of pipe and below the crown of said piece of pipe diametrically opposite the lowermost point, an inlet pipe connected to the inlet into the top of said tank and said inlet pipe extending upwardly from the top of said tank for flowing water, sewage or the like into said tank, a connection pipe having a first end connected to the upper part of said outlet section adjacent to said partially U-shaped section and a second end connected to said inlet pipe at a position adjacent to and spaced upwardly from said inlet into the top of said tank so that said connection pipe affords a venting action in said inlet pipe and in a sewer line connected to said outlet section, and said piece of pipe has said partially U-shaped section so that in the small continuous flow in said device with said tank filled to a level approximately even with the overflow level of said pipe bend the small flow entering said tank corresponds to an equally small flow which drops downwardly through said vertical pipe into said partially U-shaped section of said piece of pipe with the small flow passing out through said outlet section from said piece of pipe without completely closing the flow path through said piece of pipe at its lowermost point whereby said piece of pipe acts during such small flow as a non-sealing water trap and only acts as a sealing water trap when the incoming flow increases sufficiently to form a closure of the lowermost point of said piece of pipe whereby a plug of water forms in said piece of pipe and creates the intermittent flow of liquid in plug-like form with large kinetic energy content effecting a suction action for completely removing the contents of said tank, said partially U-shaped section comprises a bight portion including the lowermost point of said piece of said pipe, a first leg connecting said bight portion to the lower end of said generally vertically extending pipe, a second leg connecting said bight portion to said outlet section, and said second leg having a height above the invert of said bight portion less than the height of said first leg above the invert of said bight portion.

* * * * *